US012291785B2

(12) United States Patent
Ramasamy et al.

(10) Patent No.: US 12,291,785 B2
(45) Date of Patent: May 6, 2025

(54) ETHOXYLATED FATTY DIAMINE AS A CORROSION INHIBITOR FOR PIPELINES AND STORAGE TANKS

(71) Applicant: SAUDI ARABIAN OIL COMPANY, Dhahran (SA)

(72) Inventors: Jothibasu Ramasamy, Dhahran (SA); Muthukumar Nagu, Dhahran (SA); Ashok Kumar Santra, The Woodlands, TX (US); Nayef M. Alanazi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 245 days.

(21) Appl. No.: 18/058,063

(22) Filed: Nov. 22, 2022

(65) Prior Publication Data

US 2024/0183038 A1 Jun. 6, 2024

(51) Int. Cl.

| | |
|---|---|
| ***C23F 11/14*** | (2006.01) |
| ***C10G 75/02*** | (2006.01) |
| ***C10L 10/04*** | (2006.01) |

(52) U.S. Cl.

CPC ..... *C23F 11/146* (2013.01); *C10G 75/02* (2013.01); *C10L 10/04* (2013.01); *C23F 11/142* (2013.01)

(58) Field of Classification Search

CPC ..... C23F 11/146; C23F 11/142; C10L 10/04; C10G 75/02

See application file for complete search history.

(56) References Cited

U.S. PATENT DOCUMENTS

| | | |
|---|---|---|
| 2,668,100 A | 2/1954 | Luvisi |
| 2,736,658 A | 2/1956 | Pfohl et al. |

(Continued)

FOREIGN PATENT DOCUMENTS

| | | |
|---|---|---|
| EP | 1579033 B1 | 1/2013 |
| EP | 2638186 B1 | 3/2020 |

OTHER PUBLICATIONS

Muthukumar, N., et al., "Surface analysis of inhibitor films formed by 1-aminoanthraquinones on API 5L-X60 steel in diesel-water mixtures", Electrochimica Acta, ScienceDirect, Elsevier Ltd., vol. 52, 2007, pp. 7183-7192 (10 pages).

(Continued)

*Primary Examiner* — Joseph D Anthony

(74) *Attorney, Agent, or Firm* — Osha Bergman Watanabe & Burton LLP

(57) ABSTRACT

A corrosion inhibition composition includes a carrier fluid and corrosion inhibitor consisting essentially of a compound represented by Formula (I):

(I)

where $R_1$, $R_2$, $R_3$, and $R_4$ are each, independently, a hydrogen or an alkoxy group, and m and n are each, independently integers ranging from 2 to 10, where $R_5$ and $R_6$ are each, independently, a saturated $C_6$-$C_{10}$ (Continued)

hydrocarbon group or an unsaturated $C_6$-$C_{10}$ hydrocarbon group. A method of producing a corrosion inhibition composition consisting essentially of an ethoxylated diamine corrosion inhibitor and a carrier fluid and a method for inhibiting corrosion in a refined hydrocarbon-bearing system are also described.

12 Claims, 3 Drawing Sheets

(56) References Cited

U.S. PATENT DOCUMENTS

| | | | | |
|---|---|---|---|---|
| 3,365,477 | A | 1/1968 | Gee et al. | |
| 3,432,257 | A * | 3/1969 | Radder | C01G 3/003 423/139 |
| 3,766,053 | A | 10/1973 | Seffens | |
| 3,860,430 | A * | 1/1975 | Walker | C09D 5/08 252/392 |
| 3,981,682 | A | 9/1976 | Ward et al. | |
| 4,028,117 | A | 6/1977 | Moat et al. | |
| 4,148,605 | A | 4/1979 | Andress, Jr. | |
| 4,214,876 | A | 7/1980 | Garth et al. | |
| 4,470,918 | A * | 9/1984 | Mosier | C09K 8/035 508/513 |
| 4,877,578 | A | 10/1989 | Zetlmeisl et al. | |
| 5,556,575 | A | 9/1996 | Babaian-Kibala et al. | |
| 5,945,164 | A * | 8/1999 | Zaid | C08G 59/5073 427/388.5 |
| 5,961,885 | A | 10/1999 | Eaton et al. | |
| 7,407,687 | B1 * | 8/2008 | Zaid | B05D 7/222 427/230 |
| 9,434,911 | B2 | 9/2016 | Bennett et al. | |
| 10,131,622 | B1 | 11/2018 | Hilfiger et al. | |
| 10,343,976 | B1 | 7/2019 | Hilfiger et al. | |
| 10,563,114 | B2 | 2/2020 | Mandal et al. | |
| 10,934,249 | B2 | 3/2021 | Hilfiger et al. | |
| 2013/0302210 | A1 | 11/2013 | Patel et al. | |
| 2014/0349015 | A1 * | 11/2014 | Zaid | C09D 163/00 252/392 |
| 2015/0024975 | A1 | 1/2015 | Wagle et al. | |
| 2018/0119289 | A1 * | 5/2018 | Hatchman | C23F 11/145 |
| 2018/0134939 | A1 * | 5/2018 | Gupta | C09K 8/528 |
| 2021/0164112 | A1 * | 6/2021 | Henderson | C23F 11/185 |
| 2021/0380883 | A1 | 12/2021 | Dhawan et al. | |
| 2022/0002610 | A1 | 1/2022 | Melbouci et al. | |
| 2022/0396742 | A1 | 12/2022 | Nagu et al. | |

OTHER PUBLICATIONS

D. S. de Freitas et al., "Nitrogen-based corrosion inhibitor film study using weight loss and electrochemical methods in static and turbulent conditions", Materials and Corrosion, 2020, vol. 71, pp. 485-497 (13 pages).

A.M. Al-Sabagh et al., "Synthesis of non-ionic surfactants based on alkylene diamine and evaluation of their corrosion inhibition efficiency on carbon steel in formation water", Egyptian Journal of Petroleum, vol. 26, Issue 1, 2017, pp. 41-51 (11 pages).

R. B. Rabelo et al., "Development of Alkoxylated Fatty Diamines as New Film-Forming Corrosion Inhibitors", Paper presented at the OTC Brasil, Rio de Janeiro, Brazil, Oct. 2017, pp. 1-9 (9 pages).

International Search Report and Written Opinion issued in Application No. PCT/US2023/080534, mailed on Mar. 1, 2024 (12 pages).

* cited by examiner

ETHOXYLATED FATTY DIAMINE AS A CORROSION INHIBITOR FOR PIPELINES AND STORAGE TANKS

BACKGROUND

In hydrocarbon-bearing systems, such as pipelines and storage tanks, corrosion often occurs due to water contamination, bacteria, and dissolved gases present in hydrocarbon-based products. Typically, corrosion inhibitors are commonly added to fluids in hydrocarbon-bearing systems in order to protect surfaces of such systems from corrosion. Corrosion inhibitors are adsorbed on to the surface, forming a protective layer. Common corrosion inhibitors include imidazolines, amido-amines and pyrimidine salts, and tend to be expensive and toxic to people and the environment. Accordingly, there exists a need for nontoxic, inexpensive corrosion inhibitors that are effective at low concentrations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a corrosion inhibition composition that includes a carrier fluid and a corrosion inhibitor consisting essentially of a compound represented by Formula (I):

(I)

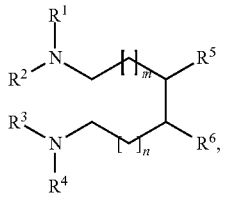

where $R_1$, $R_2$, $R_3$, and $R_4$ are each, independently, a hydrogen or an alkoxy group, and m and n are each, independently integers ranging from 2 to 10, where $R_5$ and $R_6$ are each, independently, a saturated $C_6$-$C_{10}$ hydrocarbon group or an unsaturated $C_6$-$C_{10}$ hydrocarbon group.

In another aspect, embodiments disclosed herein also relate to a method of producing a corrosion inhibition composition consisting essentially of an ethoxylated diamine corrosion inhibitor and a carrier fluid. The method includes reacting ethylene oxide with a diamine represented by Formula (III):

(III)

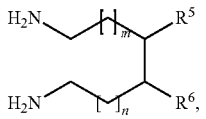

where m, n, $R_5$ and $R_6$ are as described above, thereby producing an ethoxylated diamine corrosion inhibitor represented by Formula (IV):

(IV)

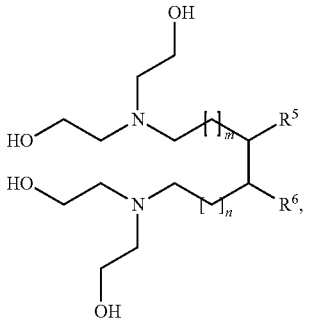

where m, n, $R_5$ and $R_6$ are as described above.

The method also includes introducing the ethoxylated diamine corrosion inhibitor to the carrier fluid.

In another aspect, embodiments disclosed herein relate to a method for inhibiting corrosion in a refined hydrocarbon-bearing system. The method includes introducing a corrosion inhibition composition to the refined hydrocarbon-bearing system, where the corrosion inhibition comprises a carrier fluid and a corrosion inhibitor composition consisting essentially of a compound represented by Formula (I) as described above and where a corrosion inhibition efficiency is at least 80% or above.

Other aspects and advantages of the claimed subject matter will be apparent from the following description and the appended claims.

DETAILED DESCRIPTION

Figure 1:
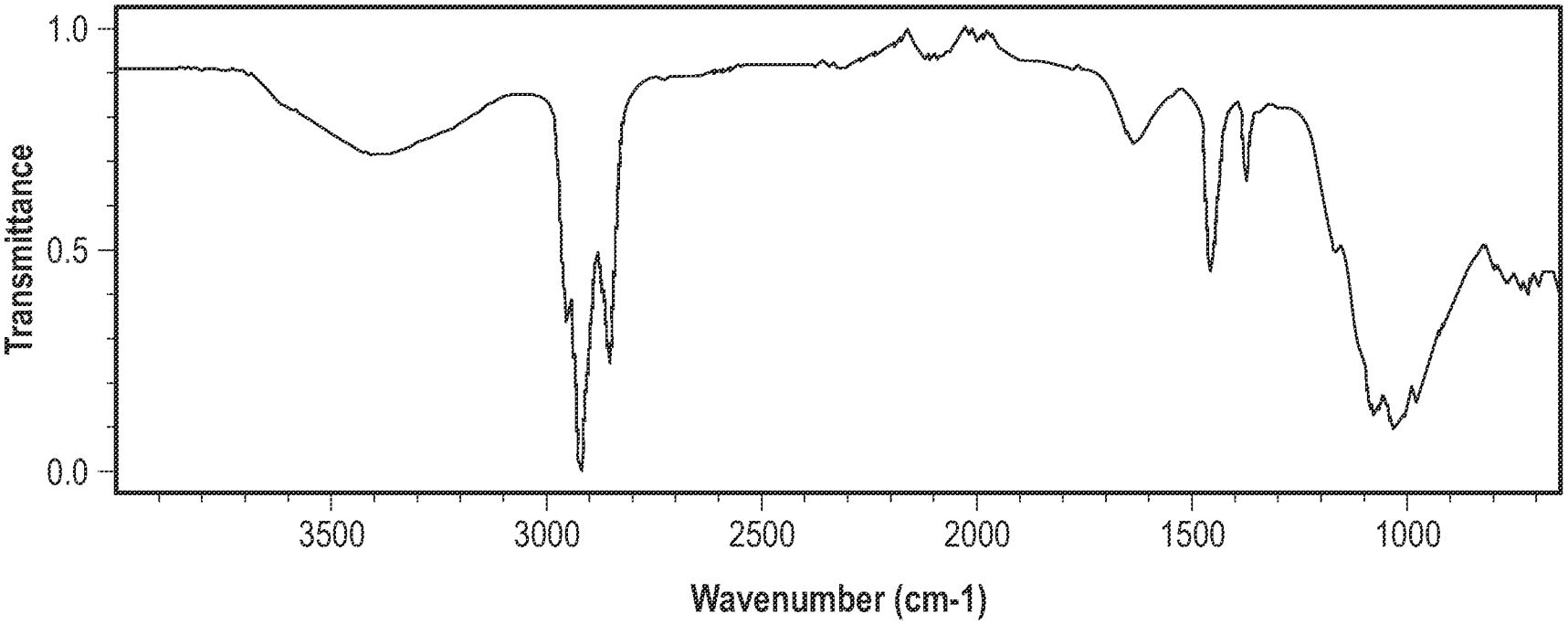
FIG. 1 is a Fourier Transform Infrared spectrum of an ethoxylated fatty corrosion inhibitor in accordance with one or more embodiments.

Embodiments in accordance with the present disclosure generally relate to corrosion inhibitor, a corrosion inhibition composition, and methods of using the corrosion inhibition composition to inhibit corrosion in a refined hydrocarbon-bearing system. The corrosion inhibitor may be derived from one or more fatty diamines. Methods of one or more embodiments involve introducing a corrosion inhibition composition to a refined hydrocarbon-bearing system. Such methods may inhibit corrosion of a refined hydrocarbon-bearing system by providing a corrosion inhibiting coating on a surface of the refined hydrocarbon-bearing system.

Corrosion Inhibition Composition

One or more embodiments of the present disclosure relate to a corrosion inhibition composition comprising a carrier fluid and a corrosion inhibitor consisting essentially of a compound represented by Formula (I):

(I)

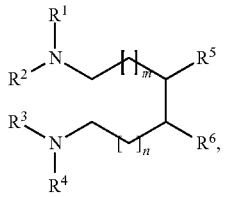

where $R^1$, $R^2$, $R^3$, and $R^4$ are each, independently, a hydrogen or an alkyl group, and m and n are each, independently integers ranging from 2 to 10, and wherein $R^5$ and $R^6$ are each, independently, a saturated $C_6$-$C_{10}$ hydrocarbon group or an unsaturated $C_6$-$C_{10}$ hydrocarbon group. The corrosion inhibitor consisting essentially of the compound represented by Formula (I) includes the compound represented by Formula (I), includes impurities not affecting corrosion inhibition activity, such as synthesis impurities, and exclude other compounds with corrosion inhibition activity. Thus, the corrosion inhibition activity of the corrosion inhibitor consisting essentially of the compound represented by Formula (I) is due to the compound represented by Formula (I). In one or more embodiments, the corrosion inhibition composition consists essentially of the present corrosion inhibitor. The corrosion inhibition composition consisting essentially of the present corrosion inhibitor includes the present corrosion inhibitor and other additives not affecting corrosion inhibition activity of the corrosion inhibitor and excludes other additives affecting corrosion inhibition activity of the corrosion inhibitor. Thus, the corrosion inhibition activity of the corrosion inhibition composition is due to the compound represented by Formula (I). The corrosion inhibitor may be the compound represented by Formula (I). Thus, in one or more embodiments, the corrosion inhibitor consists of the compound represented by Formula (I). The corrosion inhibition composition may be a combination of the carrier fluid and the corrosion inhibitor, Thus, in one or more embodiments, corrosion inhibition composition consists of the carrier fluid and the corrosion inhibitor. The corrosion inhibition activity may be corrosion resistance efficiency. In one or more embodiments, $R^1$, $R^2$, $R^3$, and $R^4$ are each, independently, a hydrocarbon group. The term "hydrocarbon group" refers to a hydrocarbon group where at least one hydrogen atom is substituted with a non-hydrogen group that results in a stable compound. Such substituents may be groups selected from, but not limited to, halo, hydroxyl, alkoxy, oxo, alkanoyl, aryloxy, alkanoyloxy, amino, alkylamino, arylamino, arylalkylamino, disubstituted amines, alkanylamino, aroylamino, aralkanoylamino, substituted alkanoylamino, substituted arylamino, substituted aralkanoylamino, thiol, alkylthio, arylthio, arylalkylthio, alkylthiono, arylthiono, aryalkylthiono, alkylsulfonyl, arylsulfonyl, arylalkylsulfonyl, sulfonamide, substituted sulfonamide, nitro, cyano, carboxy, carbamyl, alkoxycarbonyl, aryl, substituted aryl, guanidine, and heterocyclyl, and mixtures thereof. In some embodiments, the hydrocarbon group may comprise one or more alkylene oxide units. The alkylene oxide may be ethylene oxide.

In one or more embodiments, $R^1$, $R^2$, $R^3$, and $R^4$ are each, independently, a hydrogen or an alkoxy group. The alkoxy group may be a chemical structure selected from the groups consisting of a methoxy group, an ethoxy group, a propoxy group, a butoxy group, a pentoxy group, and combinations thereof.

In one or more embodiments, the corrosion inhibitor consists essentially of a compound represented by Formula (II):

(II)

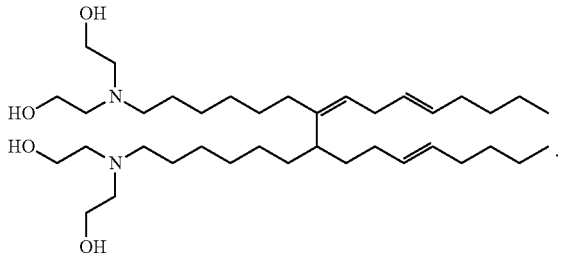

In one or more embodiments, the corrosion inhibitor is soluble in organic solvents, such as in diesel, heavy aromatic naphtha, benzene, toluene, isopropyl alcohol, or mixtures thereof. In some embodiments, the corrosion inhibitor is soluble in organic solutions in an amount of 10% by weight (wt. %) or more, 20 wt. % or more, 30 wt. % or more, or 40 wt. % or more at ambient temperature.

One or more embodiments of the present disclosure are directed to corrosion inhibition compositions. The corrosion inhibition compositions of one or more embodiments may include, for example, organic solvents as described above, water-based fluids, or combinations thereof. In one or more embodiments, the corrosion inhibition composition includes a carrier fluid. The carrier fluid may be an organic solvent. The carrier fluid may include an organic solvent selected from the group consisting of diesel, heavy aromatic naphtha, benzene, toluene, isopropyl alcohol, and combinations thereof.

The corrosion inhibition compositions of one or more embodiments may include the carrier fluid in an amount of the range of about 55 by weight (wt. %) to about 90 wt. % based on the total weight of the corrosion inhibition composition. For example, the corrosion inhibition compositions may contain the corrosion inhibitor in an amount ranging from a lower limit of any of about 55 wt. %, about 60 wt. %, about 70 wt. %, about 75 wt. %, and about 80 wt. % to an upper limit of any of about 50 wt. %, about 60 wt. %, about 70 wt. %, about 80 wt. %, about 85 wt. %, and about 90 wt. %, where any lower limit can be used in combination with any mathematically-compatible upper limit.

The corrosion inhibition compositions of one or more embodiments may include the corrosion inhibitor in an amount of the range of about 15% by weight (wt. %) to about 45 wt. % based on the total weight of the corrosion inhibition composition. For example, the corrosion inhibition compositions may contain the corrosion inhibitor in an amount ranging from a lower limit of any of about 15 wt. %, about 20 wt. %, about 25 wt. %, about 30 wt. %, about 35 wt. %, and about 40 wt. % to an upper limit of any of about 17.5 wt. %, about 20 wt. %, about 25 wt. %, about 30 wt. %, about 35 wt. %, about 40 wt. %, and about 45 wt. %, where any lower limit can be used in combination with any mathematically-compatible upper limit.

The corrosion inhibition compositions of one or more embodiments may include one or more additives. The additives may be any conventionally known and one of ordinary skill in the art will, with the benefit of this disclosure, appreciate that the selection of said additives will be dependent upon the intended application of the corrosion inhibition composition. In some embodiments, the additives include biocides.

In one or more embodiments, the corrosion inhibition composition may exhibit an improved corrosion inhibition rating as compared to a blank solution, such as a carrier fluid without a corrosion inhibitor. A corrosion inhibition rating may be determined by NACE spindle tests performed according to NACE™ 0172 (ASTM D665). For instance, a steel test specimen may be stirred at a rate of 1000 rpm (rotations per minute) in the presence of a hydrocarbon, distilled water, and air for a period of 4 hours 38° C. The distilled water may include a concentration of chloride ion. After this time period elapses, the steel test specimen is examined for corrosion and the ratings are provided as described in NACE test method and summarized in Table 1.

TABLE 1

NACE Ratings according to NACE TM 0172
NACE Ratings

| Rating | % of test surface corroded |
|---|---|
| A | 0 |
| $B^{++}$ | Less than 0.1 (2 or 3 spots of no more than 1 mm diameter) |
| $B^{+}$ | Less than 5 |
| B | 5 to 25 |
| C | 25 to 50 |
| D | 50 to 75 |
| E | 75 to 100 |

In one or more embodiments, a NACE Rating may be determined for a steel specimen by determination of an amount of corroded area. The amount of corroded area may be determined as a percentage. In one or more embodiments a percentage of a corroded area is calculated using a C10-Automated Steel Test Rod Corrosion Reader (AD Systems, France).

As measured according to the above procedure and in accordance with the values provided in Table 1, the corrosion inhibition composition in accordance with the present disclosure may have a corrosion rating of at least a C. For example, in one or more embodiments, the corrosion inhibition composition has a corrosion rating from at least a C, at least a B, at least a $B^{+}$, at least a $B^{++}$, or at least an A. In comparison, a blank solution may have a corrosion rating of an E.

In one or more embodiments, the corrosion inhibition composition exhibits electrochemical properties that correspond to improved corrosion inhibition as compared to a blank solution. Such electrochemical properties may be measured via Tafel Polarization for potentiodynamic polarization analysis in the presence of a hydrocarbon, distilled water, and air. The distilled water may include a concentration of chloride ion. For example, potentiodynamic polarization analysis may provide parameters that relate to corrosion inhibition may include corrosion kinetic parameters, such as corrosion potential ($E_{corr}$), corrosion current density ($i_{corr}$) and Tafel constants ($b_a$ and $b_c$). In one or more embodiments, the parameters of the potentiodynamic polarization analysis are calculated from the Tafel Polarization plots using Echem™ Analyst Software (GAMRY Instruments, USA).

In one or more embodiments, a measured property that relates to corrosion inhibition is the corrosion current density ($i_{corr}$). For example, the corrosion inhibition composition in accordance with the present disclosure may have an $i_{corr}$ ranging from about 0.375 μA/cm$^2$ (microAmps per centimeter squared) to about 0.425 μA/cm$^2$. For example, in one or more embodiments, the ethoxylated fatty diamine has a corrosion rate ranging from a lower limit of one of about 0.375 μA/cm$^2$, about 0.380 μA/cm$^2$, about 0.390 μA/cm$^2$, and about 0.400 μA/cm$^2$ to an upper limit of one of about 0.390 μA/cm$^2$, about 0.400 μA/cm$^2$, about 0.410 μA/cm$^2$, about 0.420 μA/cm$^2$, and about 0.425 μA/cm$^2$, where any lower limit may be paired with any mathematically compatible upper limit. In comparison, a blank solution may have a corrosion rate of at least about 4.00 μA/cm$^2$ or above.

As determined according to the above procedure, the corrosion inhibition composition in accordance with the present disclosure may have a corrosion rate ranging from about 0.10 mpy/yr (mils per year) to about 0.35 mm/yr. For example, in one or more embodiments, the ethoxylated fatty diamine has a corrosion rate ranging from a lower limit of one of about 0.10 mpy/yr, about 0.12 mpy/yr, about 0.15 mpy/yr, about 0.18 mpy/yr, about 0.20 mpy/yr, about 0.25 mpy/yr, and about 0.30 mpy/yr to an upper limit of one of about 0.22 mpy/yr, about 0.25 mpy/yr, about 0.28 mpy/yr, about 0.30 mpy/yr, and about 0.35 mpy/yr, where any lower limit may be paired with any mathematically compatible upper limit. In comparison, a blank solution may have a corrosion rate of at least about 2.00 mpy/yr or above. In one or more embodiments, the corrosion rate is determined from potentiodynamic polarization analysis, for example corrosion potential ($E_{corr}$), as calculated from Tafel Polarization plots using Echem™ Analyst Software (GAMRY Instruments, USA) and the corrosion current density ($i_{corr}$) as calculated using Echem™ Analyst Software (GAMRY Instruments, USA). In one or more embodiments, electrochemical properties that relate to corrosion inhibition properties are measured with Electrochemical Impedance Spectroscopy (EIS). Nyquist plots are two-dimensional plots of the real component of a property on one axis and the imaginary component of the property on another axis. Nyquist plots may be generated from EIS measurements. EIS measurements may provide to properties such as impedance, solution resistance, charge transfer resistance, total resistance, and rate of corrosion inhibition. In one or more embodiments, the properties obtained from EIS are calculated from the Nyquist plots using Echem™ Analyst Software (GAMRY Instruments, USA). The charge transfer resistance ($R_{ct}$), Solution resistance ($R_s$) values may be obtained from the diameter of the semi circles of the Nyquist plots using the Echem™ Analyst Software.

In one or more embodiments, the corrosion inhibition composition may exhibit an improved corrosion inhibition efficiency as compared to a carrier fluid without the corrosion inhibitor. The corrosion inhibition efficiency may be calculated using the corrosion rates of a blank sample and an inhibited sample according to Equation 1, below:

$$\text{Inhibition Efficiency } (IE, \%) = \frac{R'_{ct} - R_{ct}}{R_{ct}}, \quad (1)$$

where $R_{ct}'$ is the charge transfer resistance of an inhibited solution (i.e., in the presence of a corrosion inhibition composition) and $R_{ct}$ is the charge transfer resistance of a blank solution (i.e., in the absence of the corrosion inhibition composition).

In one or more embodiments, the corrosion inhibition efficiency is calculated using the corrosion rates of a blank sample and an inhibited sample according to Equation 2, below:

$$\text{Inhibition Efficiency (\%)} = \frac{CR_o - CR_I}{CR_o} \times 100, \quad (3)$$

where $CR_o$ is the corrosion rate of a blank solution (i.e., in the absence of the corrosion inhibition composition), and $CR_I$ is the corrosion rate of an inhibited solution, (i.e., a solution including ethoxylated fatty diamine of one or more embodiments).

Whereas a blank solution may have a corrosion inhibition efficiency of about 15%, an inhibited solution including ethoxylated fatty diamine may have a corrosion efficiency ranging from about 75 to about 99%. For example, when adsorbed to a steel surface, the corrosion inhibition composition of one or more embodiments may inhibit corrosion with an efficiency ranging from a lower limit of one of about 75%, about 80%, about 85%, about 90%, about 92%, about 94%, about 96%, and about 98% to an upper limit of one of about 90%, about 91%, about 92%, about 93%, about 94%, about 95%, about 97, and about 99%, where any lower limit may be paired with any mathematically compatible upper limit.

Producing a Corrosion Inhibition Composition

One or more embodiments of the present disclosure are directed to production of a corrosion inhibition composition as described above. Producing the corrosion inhibition composition includes a synthesis of the corrosion inhibitor represented by the aforementioned Formula (I). The corrosion inhibitor represented by the aforementioned Formula (I) may be a reaction product derived from a diamine represented by Formula (III):

(III)

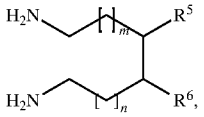

wherein $R^5$ and $R^6$ are each, independently, a saturated $C_6$-$C_{10}$ hydrocarbon group or an unsaturated $C_6$-$C_{10}$ hydrocarbon group.

In one or more embodiments, the diamine represented by Formula (III) is a fatty diamine. The fatty diamine may be extracted and isolated from a fatty diamine source, synthetically derived, or the fatty diamine may be obtained from a commercial source, such as Priamine™ 1074 (Croda Smart Materials).

In one or more embodiments, a diamine of Formula (III) is reacted with an electrophilic hydrocarbon to produce a corrosion inhibitor represented by the aforementioned Formula (I). The electrophilic hydrocarbon may include an alkyl chain. The alkyl chain may include a saturated $C_2$-$C_5$ hydrocarbon group or an unsaturated $C_2$-$C_5$ hydrocarbon. In one or more embodiments, the alkyl chains include a heteroatom, such as oxygen, nitrogen, or sulfur.

In one or more embodiments, the electrophilic hydrocarbon is selected from the group consisting of an alkyl halide, a heterocycle, and combinations thereof. The electrophilic hydrocarbon may include an epoxide, such as ethylene oxide.

As noted above, one or more embodiments also relate to producing a corrosion inhibition composition. In one or more embodiments, producing a corrosion inhibitor represented by the aforementioned Formula (I) includes reacting a fatty diamine with an electrophilic hydrocarbon in a molar ratio of at least 1:1. The a fatty diamine may be reacted with the electrophilic hydrocarbon in a molar ratio of at least 1:2. The a fatty diamine may be reacted with the electrophilic hydrocarbon in a molar ratio of at least 1:3. The a fatty diamine may be reacted with the electrophilic hydrocarbon in a molar ratio of at least 1:4.

A non-limiting example of a reaction between a commercially available diamine (Priamine™ 1074) and ethylene oxide is shown in Equation 2, below.

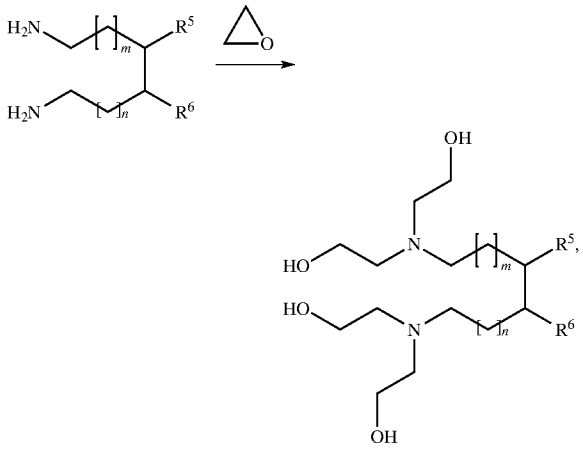

(4)

wherein m, n, $R^5$ and $R^6$ are as described above. As such, the reaction of Equation 4 may produce a an ethoxylated diamine corrosion inhibitor represented by Formula (IV):

(IV)

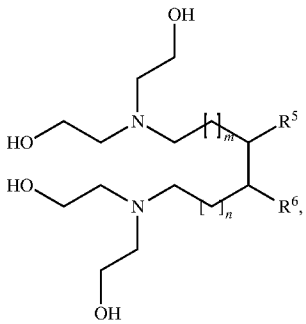

wherein m, n, $R^5$ and $R^6$ are as described above.

The diamine and the ethylene oxide may react under inert conditions. The diamine and the ethylene oxide may be introduced to a sealed reactor vessel, such as a Parr reactor vessel. In one or more embodiments, the reaction may be monitored for changes in temperature, pressure, or both. The temperature may be monitored with a thermocouple connection to the reactor vessel. The pressure may be monitored with a pressure gauge connected to the reactor vessel. The pressure of the reactor vessel may be monitored for pressure changes. In one or more embodiments, the reaction is determined to be complete when no pressure changes are observed. The reaction may be stopped when no further changes in pressure are observed via monitoring of the pressure gauge of the reactor vessel. In some embodiments, the reaction product is used as the corrosion inhibitor without further isolation and/or purification processes.

The corrosion inhibitor may be characterized according to methods known to one of ordinary skill in the art, such as Fourier Transform Infrared Spectroscopy (FTIR), nuclear magnetic resonance (NMR), mass spectrometry (MS), among others.

In one or more embodiments, the corrosion inhibitor is introduced to the carrier fluid to produce the corrosion inhibition composition. The corrosion inhibitor may be introduced to the carrier fluid in an amount in a range as described above. The carrier fluid may be a fluid as described above.

Method of Inhibiting Corrosion

Methods in accordance with the present disclosure may include introducing a corrosion inhibition composition into a refined hydrocarbon-bearing system. The refined hydrocarbon-bearing system may include a system for which refined hydrocarbons are stored, transported, or both. In one or more embodiments, the refined hydrocarbon-bearing system is a pipeline, a storage tank, or both.

In one or more embodiments, the corrosion inhibition composition is diluted prior to introduction to a refined hydrocarbon-bearing system. The corrosion inhibition composition may be diluted in solution a range from about 1 ppm to about 500 ppm. For example, when adsorbed to a steel surface, the corrosion inhibition composition of one or more embodiments may inhibit corrosion with an efficiency ranging from a lower limit of one of about 1 ppm, about 5 ppm, about 10 ppm, about 25 ppm, about 50 ppm, about 75 ppm, about 100 ppm, about 150 ppm, and about 200 ppm, to an upper limit of one of about 200 ppm, about 300 ppm, about 400 ppm, and about 500 ppm, where any lower limit may be paired with any mathematically compatible upper limit.

The corrosion inhibition composition or the diluted corrosion inhibition composition may be a single treatment fluid that is introduced into a refined hydrocarbon-bearing system. The single treatment fluid may be a single organic molecule system. The corrosion inhibition composition may be injected in a pre-flushing step prior to the introduction of one or more refined hydrocarbons. The pre-flushing may limit the interaction between one or more corrosive chemicals from refined hydrocarbons with an internal surface of the hydrocarbon-bearing system.

The introduction of the corrosion inhibition composition or the diluted corrosion inhibition composition may be performed before the introduction of the refined hydrocarbons to the system such that a coating is formed on an internal surface of the system. The coating formed on the internal surface of the system may form from an interaction between the corrosion inhibitor and a material of the internal surface. The material of the internal surface may be a metallic material, such as steel. The coating formed on the internal surface of the system may mitigate or prevent corrosion of the internal surface of the system.

In one or more embodiments, the corrosion inhibition composition is introduced into a refined hydrocarbon-bearing system containing refined hydrocarbons. The corrosion or the diluted corrosion inhibition composition may be continuously introduced in a refined hydrocarbon-bearing system. The corrosion inhibition may limit the interaction between one or more corrosive chemicals from refined hydrocarbons with an internal surface of the hydrocarbon-bearing system. The corrosion inhibition may inhibit the interaction between one or more corrosive chemicals from refined hydrocarbons with an internal surface of the hydrocarbon-bearing system.

EXAMPLES

The following examples are merely illustrative and should not be interpreted as limiting the scope of the present disclosure.

Synthesis and Characterization of a Corrosion Inhibitor

Priamine™ 1074 (100 g, grams, 447.816 g/mol, grams per mole) was introduced into a reactor vessel equipped with a thermocouple and a gas entry. Ethylene oxide obtained from Linde Gas (39.35 g, 44.05 g/mol) was added to the reaction vessel. The reaction mixture was stirred and pressure inside the vessel was continuously monitored. The mixture was allowed to stir until change in pressure was no longer observed. At which point, the stirring was stopped, and the reaction product was collected from the reactor vessel in an amount of 139.35 g.

The synthesized ethoxylated fatty diamine corrosion inhibitor was characterized in a 40 wt. % solution of diesel by FTIR spectroscopy as shown in FIG. 1. The presence of strong bands at around 2900 $cm^{-1}$ of FIG. 1 confirm the presence of hydroxyl groups.

Corrosion Inhibitor Composition

The corrosion inhibition composition was produced by dissolving 20 wt. % of the synthesized ethoxylated fatty diamine corrosion inhibitor in diesel based on the total weight of the corrosion inhibition composition.

NACE Spindle Tests

NACE spindle tests (NACE™ 0172, ASTM D665) were performed by preparing a blank solution and a test solution. The blank solution included 300 mL of diesel. The test solution included 0.01 wt. % of the corrosion inhibition composition based on the total weight of test solution.

Each solution was heated, and when the temperature of the fuel sample was approximately 38±1° C. (100±2° F.) as measured with a thermocouple, a steel test specimen was introduced. Each steel specimen was stirred at a rate of 1,000±50 rpm for 30 minutes at this elevated temperature to ensure complete wetting of the steel test specimen in the blank solution or in the test solution.

With the stirrer in motion, the thermocouple was removed temporarily, and 30 mL of distilled water was added, discharging the water into the bottom of the beaker. This addition of water was performed by injecting the water with a syringe through a needle. After the injection of water, the thermocouple was replaced.

Stirring was continued at a speed of 1,000±50 rpm for 3.5 hours from the time the water was added, maintaining the temperature of the fuel-water mixture at 38±1° C. (100±2° F.). The stirring was then stopped at the end of the 3.5-hours test period. The steel specimen were removed, and remaining solutions were allowed to drain from the specimen. The steel specimen were then washed with toluene or xylene followed by acetone.

After this washing, the steel test specimen were evaluated for corroded area, and NACE ratings were determined in accordance with to Table 1, above. A percent corroded area was calculated for each of the steel specimen by using a CT10—Automated Steel Test Rod Corrosion Reader from AD systems, France. NACE spindle test ratings and amount of corroded areas are shown in Table 2, below.

TABLE 2

NACE spindle test data of Ethoxylated Fatty diamine

| Solution | NACE Rating | Corroded Area (%) |
|---|---|---|
| Blank | E | 86 |
| Test | $B^+$ | 3.09 |

The test solution including the corrosion inhibition composition was determined to have excellent corrosion inhibition efficiency as indicated by a NACE rating of B and 3.09% corroded area when compared to a blank solution (without a corrosion inhibitor) with a NACE rating of E and 86% corroded area.

Tafel Polarization Measurements and Electrochemical Impedance Spectroscopy Measurements The blank solution and the test solution included an aqueous solution in a 1:2 ratio with diesel. The aqueous solution included 120 ppm of chloride ions prepared by dissolving sodium chloride (200 ppm) in water. In these experiments, a working electrode (steel; C1018) was immersed and stirred vigorously for a period of 7 days. After the test period, electrochemical tests were carried out in an electrochemical cell containing aqueous medium collected from experimental system. The test solution included 0.01 wt. % of the corrosion inhibition composition based on the total weight of test solution.

The electrochemical experiments were performed using a conventional three-electrode cell assembly at 25° C. The working electrode was a steel (C1018) sample of 9 $cm^2$ (centimeters squared), and the remaining portion of the steel sample was covered with araldite epoxy. A large rectangular platinum foil was used as counter electrode and saturated calomel electrode as the reference electrode. The working electrode was polished with different grades of emery papers, washed with water and degreased with trichloroethylene.

The polarization and impedance studies were measured after 30 min of immersion using Gamry Instruments (Model 1010E). The polarization analyses were performed using a Gamry software from a cathodic potential of −0.2V (Volts) to an anodic potential of +0.2V with respect to the corrosion potential at a sweep rate of 0.167 mV/s (milliVolts per second) in accordance with ASTM method G59-97. The data in the Tafel region (−0.2 to +0.2V versus corrosion potential) were processed for evaluation of corrosion kinetic parameters as shown in FIG. 2.

Figure 2:
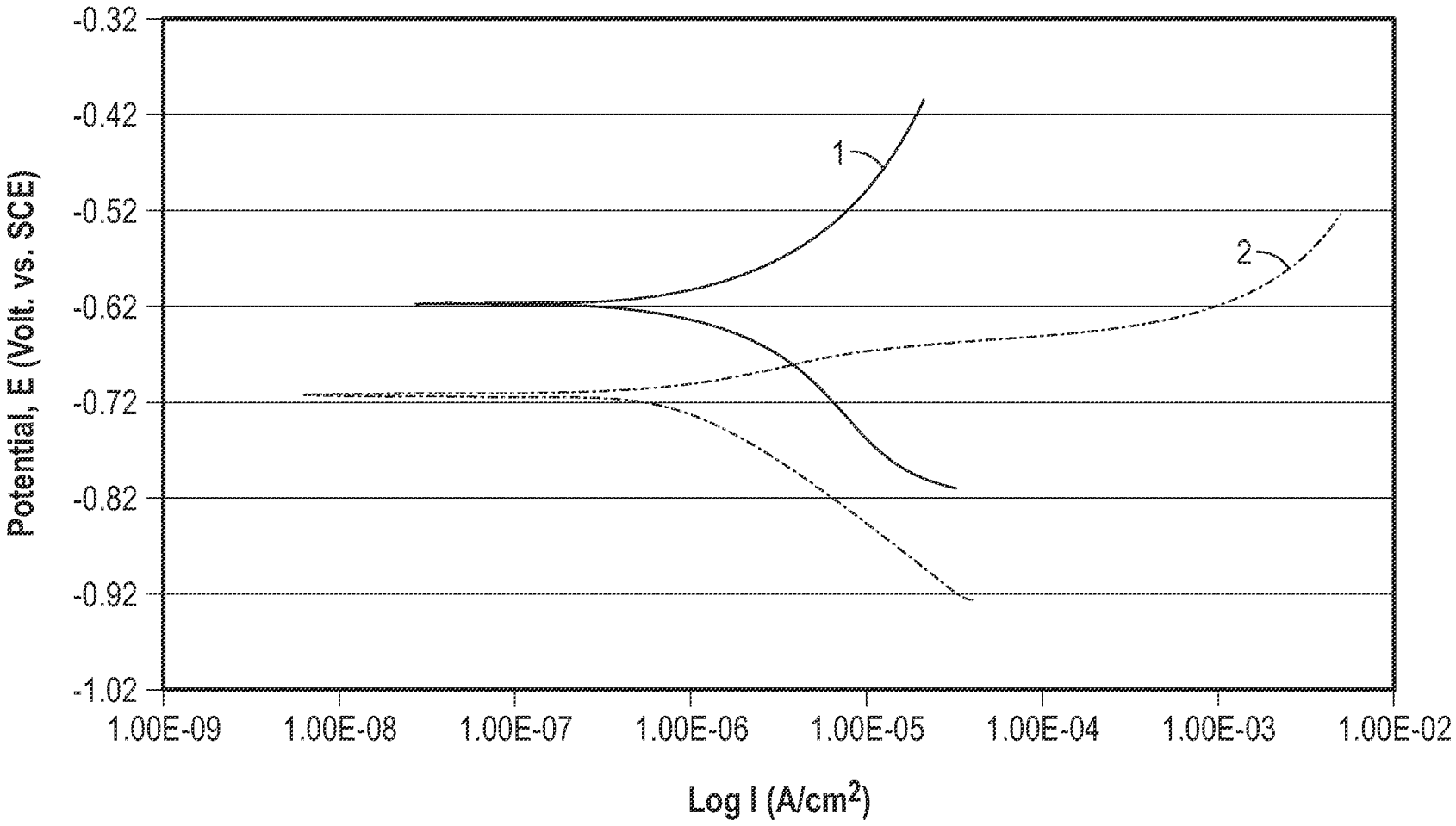
FIG. 2 is a potentiodynamic polarization plot of potential vs the log of current density that is derived from Tafel polarization measurements of a blank solution and test solution in accordance with one or more embodiments.

The plot of FIG. 2 represents a potential (E) on the y-axis (Volts vs. SCE) versus logarithmic value of current (I) in amps per centimeters squared ($A/cm^2$) on the x-axis, where SCE represents saturated calomel electrode. The solid line 1 of FIG. 2 represents measurements obtained for the blank solution. Dashed line 2 of FIG. 2 represents measurements obtained for the test solution.

The corrosion kinetic parameters of the potentiodynamic polarization analysis were calculated from the Tafel Polarization plots using Echem™ Analyst Software (GAMRY Instruments, USA).

The linear Tafel segments of the anodic and cathodic curves were extrapolated to corrosion potential in order to determine the corrosion current values as presented in Table 3. The corrosion inhibition efficiency of each solution was calculated using the Equation 3 described above.

TABLE 3

Potentiodynamic polarization analysis of Carbon Steel (C1018).

| Solution | $E_{corr}$ (mV) | $b_a$ (mV/dec) | $b_c$ (mV/dec) | $I_{corr}$ ($\mu A/cm^2$) | Corrosion Rate ( mpy) | Inhibition Efficiency (%) |
|---|---|---|---|---|---|---|
| Blank | −618 | 281 | 400 | 4.51 | 2.062 | NA |
| Test | −356 | 86 | 319 | 0.381 | 0.1742 | 92 |

It was determined that 92% corrosion inhibition was achieved with the corrosion inhibition composition at 100 ppm concentration. The corrosion rate was 0.1742 mpy for the test solution with the corrosion inhibition composition, when compared to blank solution corrosion rate of 2.062 mpy at 25° C.

Figure 3:
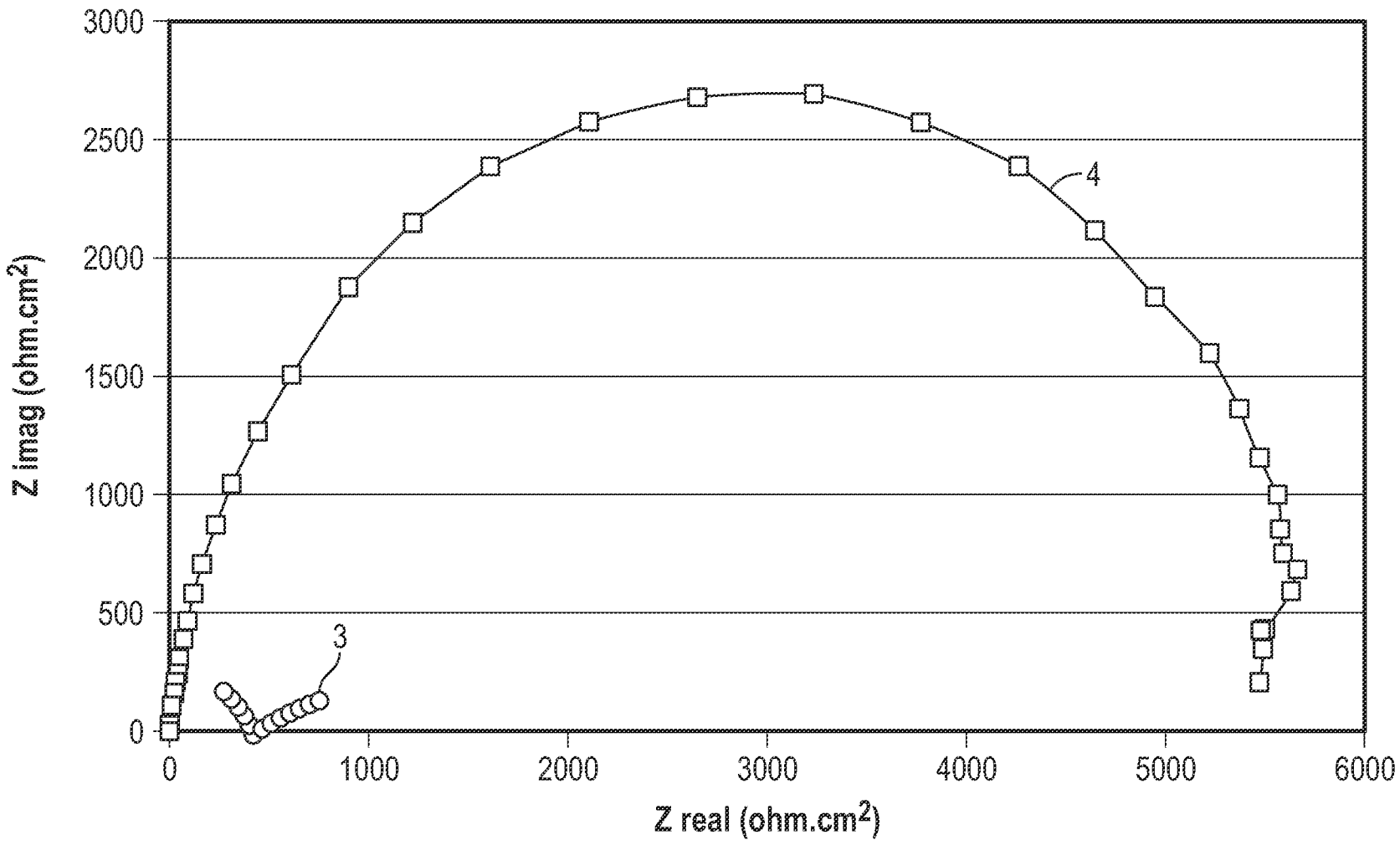
FIG. 3 is a Nyquist impedance plot that is derived from electrochemical impedance spectroscopy of a blank solution and a test solution in accordance with one or more embodiments.

The electrochemical impedance spectroscopy measurements were performed using alternating current (AC) signals with a 10 mV (millivolt) amplitude for the frequency spectrum from 100 kHz (kilohertz) to 0.01 Hz (Hertz). The Nyquist plots of electrochemical impedance spectroscopic measurements of the blank and test solutions are shown in FIG. 3. The Nyquist plots of FIG. 3 represent the imaginary electrical resistivity ($Z_{imag}$) represented in ohms-centimeters squared ($\Omega \cdot cm^2$) on the y-axis versus the real electrical resistivity ($Z_{reg}$) represented in ohms-centimeters squared ($\Omega \cdot cm^2$) on the x-axis. FIG. 3 shows that the Nyquist plot of test solution, as indicated by line 4, demonstrated a larger diameter when compared to blank solution (line 3), which indicates that the test solution with the corrosion inhibition composition has higher corrosion inhibition efficiency in diesel-water mixtures at 25° C. The electrochemical impedance parameters were calculated from generated Nyquist plots using Echem™ Analyst Software (GAMRY Instruments, USA).

Table 4, shown below, provides electrochemical impedance parameters for the blank and test solutions. As indicated by the results in Table 4, the blank system was determined to have very little resistance (445 $\Omega \cdot cm^2$) whereas the synthesized compound showed high resistance (6429 $\Omega \cdot cm^2$). Such results indicate that the electrode impedance was significantly increased by the addition of the corrosion inhibition composition of 100 ppm when compared to blank experiment. In addition, the capacitance value was lower in the test solution when compared to the blank solution, which confirms that the corrosion inhibitor can be adsorbed on to metal surfaces as a protective film that can reduce the dielectric constant present on the metal surfaces.

TABLE 4

Electrochemical impedance parameters of carbon steel (C1018)

| Solution | Solution Resistance, $R_s$ ($\Omega \cdot cm^2$) | Charge Transfer resistance, $R_{ct}$ ($\Omega \cdot cm^2$) | Total Resistance, $R_T$ ($\Omega \cdot cm^2$) | Corrosion Inhibition (%) |
|---|---|---|---|---|
| Blank | 289 | 734 | 445 | NA |
| Test | 302 | 6731 | 6429 | 96 |

Embodiments of the present disclosure may provide at least one of the following advantages. The corrosion inhibition composition may be added to refined hydrocarbon-bearing systems to inhibit or prevent corrosion of the system. The corrosion inhibition may be introduced to a refined hydrocarbon-bearing system to provide a coating on an internal surface of the system. In one or more embodiments, the protective coating inhibits or prevents interaction between corrosive chemicals in a refined hydrocarbon.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for inhibiting corrosion in a refined hydrocarbon-bearing system, the method comprising:

introducing a corrosion inhibition composition to the refined hydrocarbon-bearing system, wherein the corrosion inhibition composition comprises a carrier fluid and a corrosion inhibitor consisting essentially of a compound represented by Formula (I):

(I)

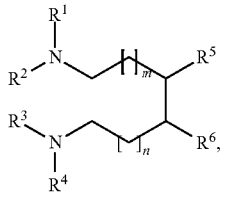

wherein:

$R^1$, $R^2$, $R^3$, and $R^4$ are each, independently, a hydrogen or an alkoxy group, and m and n are each, independently integers ranging from 2 to 10, wherein:

at least one of $R^1$, $R^2$, $R^3$, and $R^4$ is the alkoxy group; and $R^5$ and $R^6$ are each, independently, a saturated $C_6$-$C_{10}$ hydrocarbon group or an unsaturated $C_6$-$C_{10}$ hydrocarbon group, and wherein the corrosion inhibition efficiency is at least 80% or above.

2. The method of claim 1, wherein the corrosion inhibition efficiency is at least 90% or above.

3. The method of claim 1, wherein the refined hydrocarbon-bearing system comprises a pipeline, a storage tank, or both.

4. The method of claim 1, further comprising providing the corrosion inhibition composition comprising dissolving the corrosion inhibitor in the carrier fluid.

5. The method of claim 1, wherein the corrosion inhibitor consists essentially of a compound represented by Formula (II):

(II)

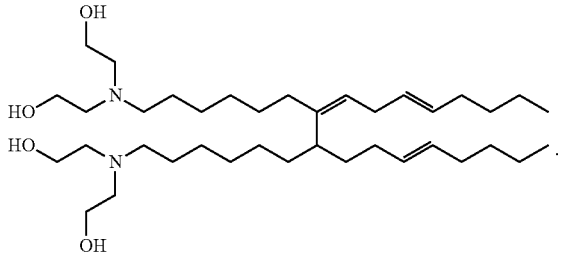

6. The method of claim 1, further comprising providing a coating on an internal surface of the hydrocarbon-bearing system.

7. The method of claim 1, further comprising dissolving the corrosion inhibitor in a range from about 20 wt % to about 30 wt % in the carrier fluid based on the total weight of the corrosion inhibition composition.

8. The method of claim 1, wherein the carrier fluid is selected from the group consisting of diesel, heavy aromatic naphtha, benzene, toluene, isopropyl alcohol, and combinations thereof.

9. The method of claim 1, further comprising producing the corrosion inhibitor consisting essentially of a compound represented by Formula (I) by reacting ethylene oxide with a diamine represented by Formula (III):

(III)

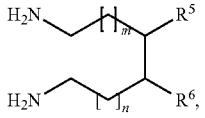

wherein $R^5$ and $R^6$ are each, independently, a saturated $C_6$-$C_{10}$ hydrocarbon group or an unsaturated $C_6$-$C_{10}$ hydrocarbon group.

10. The method of claim 1, wherein the alkoxy group is selected from the group consisting of methoxy, ethoxy, propoxy, butoxy, pentoxy, and combinations thereof.

11. The method of claim 1, wherein the at least one of $R^1$, $R^2$, $R^3$, and $R^4$ is an ethoxy group.

12. The method of claim 1, wherein $R^1$, $R^2$, $R^3$, and $R^4$ are each, independently, an ethoxy group.

* * * * *